US012220787B2

(12) United States Patent
Thiyahuddin

(10) Patent No.: US 12,220,787 B2
(45) Date of Patent: Feb. 11, 2025

(54) SYSTEM AND METHOD FOR CUTTING OF OFFSHORE STRUCTURES

(71) Applicant: Petroliam Nasional Berhad (PETRONAS), Kuala Lumpur (MY)

(72) Inventor: Mohd Izzat Mohd Thiyahuddin, Kuala Lumpur (MY)

(73) Assignee: Petroliam Nasional Berhad (PETRONAS), Kuala Lumpur (MY)

( * ) Notice: Subject to any disclaimer, the term of this patent is extended or adjusted under 35 U.S.C. 154(b) by 374 days.

(21) Appl. No.: 17/774,902

(22) PCT Filed: Nov. 6, 2020

(86) PCT No.: PCT/MY2020/050136

§ 371 (c)(1),
(2) Date: May 6, 2022

(87) PCT Pub. No.: WO2021/091368

PCT Pub. Date: May 14, 2021

(65) Prior Publication Data

US 2022/0388119 A1 Dec. 8, 2022

(30) Foreign Application Priority Data

Nov. 6, 2019 (MY) ..... MYPI2019006497

(51) Int. Cl.
*E21B 29/12* (2006.01)
*B24C 1/04* (2006.01)
(Continued)

(52) U.S. Cl.
CPC ..... *B24C 1/045* (2013.01); *B24C 3/32* (2013.01); *B24C 9/00* (2013.01); *E02B 17/0034* (2013.01);
(Continued)

(58) Field of Classification Search
CPC E21B 29/12; B24C 1/045; B24C 3/32; B24C 9/00
See application file for complete search history.

(56) References Cited

U.S. PATENT DOCUMENTS 3,526,162 A * 9/1970 Willcox ..... B28B 17/0036 83/16
4,447,952 A 5/1984 Elkins
(Continued)

FOREIGN PATENT DOCUMENTS

CN 109015391 A * 12/2018 ..... B24C 1/003
WO WO-0103887 A1 * 1/2001 ..... B24C 1/003
WO WO-2009122203 A1 10/2009

OTHER PUBLICATIONS

Getu H. et al.. *Thermal analysis of cryogenically assisted abrasive jet micromachining of PDMS*, International Journal of Machine Tools and Manufacture, No. 9, (2011), pp. 721-730.
(Continued)

*Primary Examiner* — Matthew R Buck
(74) *Attorney, Agent, or Firm* — Bradley Arant Boult Cummings LLP

(57) ABSTRACT

A system for cutting an underwater structure, the system comprising: a cutting head, said cutting head comprising: an abrasive water jetting nozzle; a cryogenic nozzle; said abrasive water jetting nozzle and cryogenic nozzle mounted in fixed spaced relation; said cutting head arranged to position tips of the nozzles proximate to a cutting surface, and arranged to form a cutting zone defined by the nozzle tips and cutting surface; wherein a water repelling shield is located about said cutting zone and arranged to hinder water entering said cutting zone.

11 Claims, 4 Drawing Sheets

(51) Int. Cl.
*B24C 3/32* (2006.01)
*B24C 9/00* (2006.01)
*E02B 17/00* (2006.01)

(52) U.S. Cl.
CPC ..... *E21B 29/12* (2013.01); *E02B 2017/0052* (2013.01)

(56) References Cited

U.S. PATENT DOCUMENTS

| | | | | |
|---|---|---|---|---|
| 4,902,168 | A * | 2/1990 | Wang | E02D 9/04 405/195.1 |
| 7,922,424 | B2 * | 4/2011 | Clark, II | B23D 57/0061 83/200.1 |
| 2012/0137846 | A1 | 6/2012 | Quintard et al. | |
| 2014/0157963 | A1 | 6/2014 | Von Wirth et al. | |
| 2015/0337634 | A1 | 11/2015 | O'Leary et al. | |
| 2018/0291697 | A1 | 10/2018 | Oag et al. | |

OTHER PUBLICATIONS

Herghelegiu E. et al., *Influence of the Distance between the Cutting Head and Working Sample on the Geometric Precision in Water Jet Abrasive Cutting Process*, Applied Mechanics and Materials, vol. 371, (2013), pp. 240-244.

Al-Motin, Abdulla; International Search Report; PCT/MY2020/050136; dated Feb. 1, 2021; 4 pages.

* cited by examiner

SYSTEM AND METHOD FOR CUTTING OF OFFSHORE STRUCTURES

FIELD OF THE INVENTION

The invention relates to offshore structures such as pylons, well heads and other steel structures located offshore including those located underwater. Specifically the invention relates to the means of cutting these structures above or below seabed.

BACKGROUND

In conducting maintenance or site reparation, it is necessary to cut through steel structures whilst underwater and, for offshore conditions, at significant depth. The cutting may be for the purpose of repairing the structure or for its removal. Further, in order to avoid a structure projecting from the sea bed, it may be necessary to cut below the level of the sea bed.

Several techniques have been used including hydraulic shears, being mechanical severing devices, particularly for relatively thin material such as less than 50 mm. More difficult and complex techniques include shaped explosive charges, laser cutting and chemical attack, however none of these provide an efficient means of cutting underwater structures for various reasons.

The two most popular methods include diamond wire cutting and abrasive water jetting. For offshore applications, both require a significant deck area to support the equipment infrastructure. Further, diamond wire cutting requires divers and remotely operated vehicle, whereas abrasive water jetting requires a considerable amount of time (six to eight hours) in order to effect the cut.

SUMMARY OF INVENTION

In a first aspect the invention provides a system for cutting an underwater structure, the system comprising: a cutting head, said cutting head comprising: an abrasive water jetting nozzle; a cryogenic nozzle; said abrasive water jetting nozzle and cryogenic nozzle mounted in fixed spaced relation; said cutting head arranged to position tips of the nozzles proximate to a cutting surface, and arranged to form a cutting zone defined by the nozzle tips and cutting surface; wherein a water repelling shield is located about said cutting zone and arranged to hinder water entering said cutting zone.

In a second aspect the invention provides a method for cutting an underwater structure, the method comprising the steps of: placing an abrasive water jetting nozzle and a cryogenic nozzle in fixed spaced relation to form a cutting head positioning said cutting head proximate to a cutting surface of said structure; forming a cutting zone defined by tips of the abrasive water jetting nozzle and a cryogenic nozzle and the cutting surface; locating a water repelling shield about said cutting zone and so; hindering water entering said cutting zone, and; cutting said cutting surface using the abrasive water jet emanating from said abrasive water jetting nozzle.

Thus, a combination of features assist to make abrasive water jetting a viable option. Firstly, using cryogenic assistance to the water jetting by reducing the metal temperature to below the ductile-brittle transition. By making the steel brittle, its ability to absorb energy is reduced making the water jet more effective, and so able to act faster. Further, by introducing an air envelope, the surrounding water is prevented from raising the temperature of the steel, through efficient heat transfer, before the water jet can act.

BRIEF DESCRIPTION OF DRAWINGS

It will be convenient to further describe the present invention with respect to the accompanying drawings that illustrate possible arrangements of the invention. Other arrangements of the invention are possible and consequently, the particularity of the accompanying drawings is not to be understood as superseding the generality of the preceding description of the invention.

DETAILED DESCRIPTION

Figure 1:
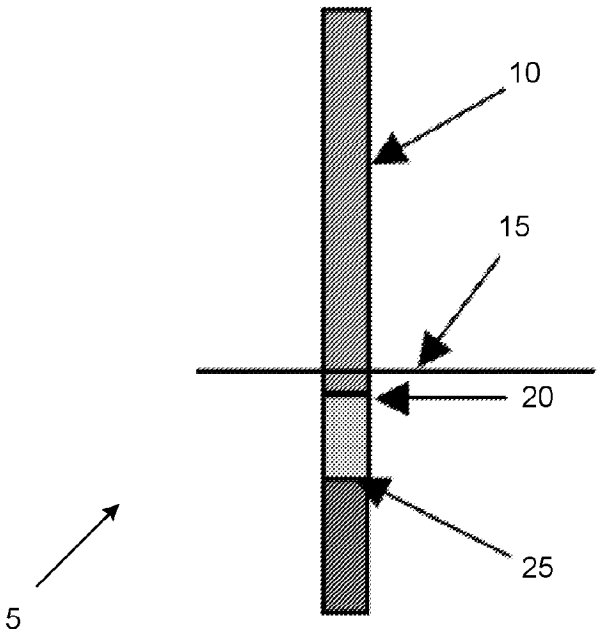
FIG. 1 is a schematic view of an offshore structure to be cut.

FIG. 1 shows an elevation view of the type of underwater structure 5 to which the present invention is applicable. In particular, a jacket 10 comprising a tubular steel structure maybe embedded in the seabed 15. Embedment will inevitably create a soil plug 25 within the tubular structure. By way of example, the tubular steel structure 10 may have a 50 mm wall thickness and, in order, to return the site to its original condition such that no structure projects from the seabed 15, a cut line 20 may be identified at, for instance, one to three meters below the seabed 15. It will be appreciated that given the cut line 20 is below the seabed 15, site preparation leading to the cutting process will depend upon the area around the jacket 10 that needs to be cleared in order to utilize the cutting system. Thus, a cutting system that is large and bulky, for instance, a hydraulic shear or diamond wire cutter will require additional preparation time extending the time for which the cutting process requires. In consideration of time taken to complete the task, given that conventional abrasive water jetting requires up to six to eight hours, there is a considerable amount of time that is required to provide support for the cutting process. If the entire project involves many such jackets 10, then it is clear such an approach may not be economically viable.

The present invention therefore involves two steps. It is accepted that abrasive water jetting is a useful technique for cutting steel, however the duration required under normal circumstances is problematic. By cryogenically freezing the steel structure just prior to the water jetting, a significant benefit may be achieved leading to a faster cutting process of the cryogenically brittle steel.

However, cryogenically freezing the steel is difficult in an underwater application. The present invention therefore further includes an air envelope and habitat surrounding a cryogenic nozzle and nozzle of the water jetting system.

Figure 2:
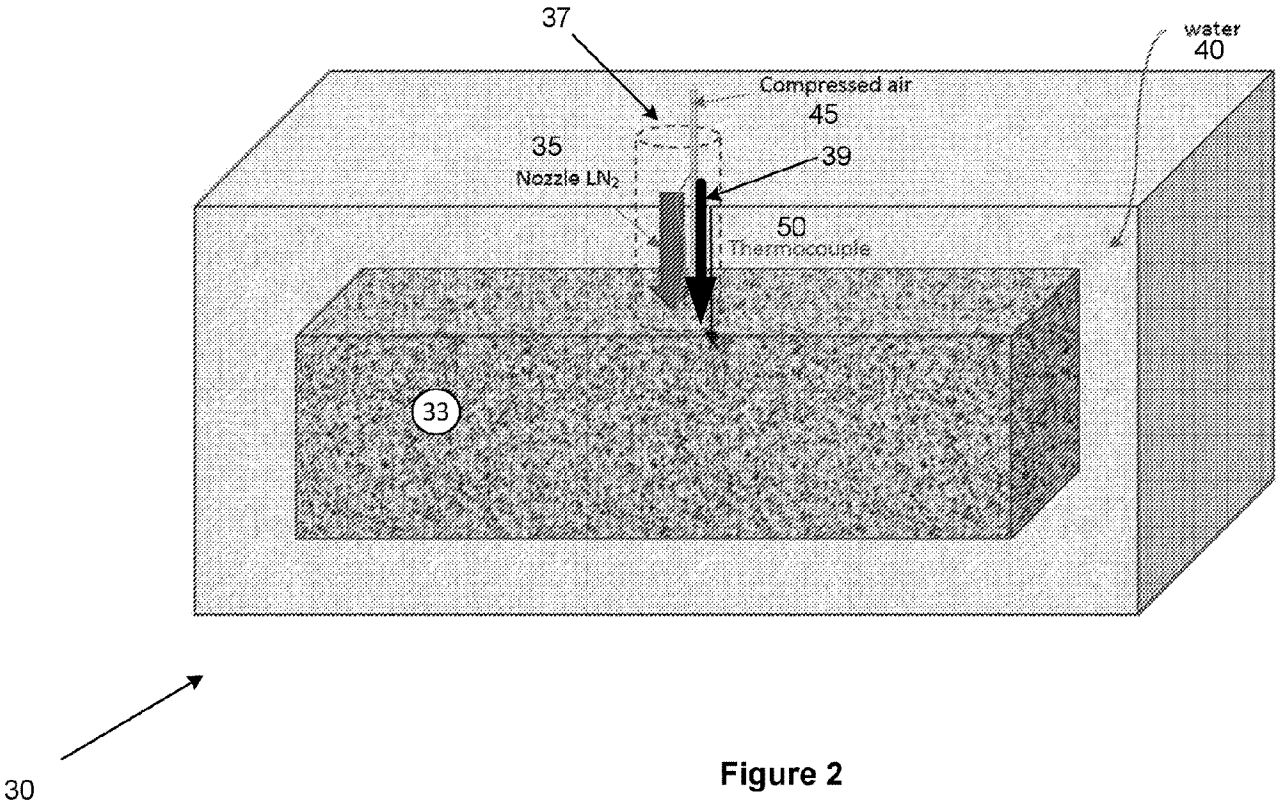
FIG. 2 is a schematic view of a cutting process according to one embodiment of the present invention.

FIG. 2 shows a schematic view of a cutting arrangement 30 whereby a cryogenic nozzle 35 applies liquid nitrogen to the cutting zone 37. Compressed air 45 is injected into the cutting zone which includes water jetting nozzle 39. The cutting zone 37 provides arid conditions in which to cool and cut the steel 33 whilst underwater 40. A thermocouple 50 may be provided within the cutting zone 37 so as to monitor temperature and ensure cryogenic conditions exist during the cutting process.

As discussed, an important consideration in cryogenically assisted water jetting is to ensure the material to be cut 33 remains brittle during cutting. At ambient temperatures, ductility of steel remains relatively constant. As the temperature of the metal is reduced, a ductile-brittle transition (DBT) is reached. As a non-limiting example, this transition may be in the range −90° C. to −130° C. It will be appreciated that the ductile-brittle transition for a material may be different for each material, and so appropriate testing of the material may be required.

Whilst above ground applications of cryogenic assisted water jetting can be carried out relatively simply, heat transfer under water is such that any time lag between the introduction of liquid nitrogen and subsequent water jetting may be sufficient to elevate the temperature of the cutting zone above the ductile-brittle transition temperature.

Accordingly, the introduction of an air envelope 37, which in this case is provided by the introduction of compressed air 45, removes water from the cutting zone 37 and thus limits heat gained through immersion in water, which is a more efficient heat transfer medium than air.

Figure 3:
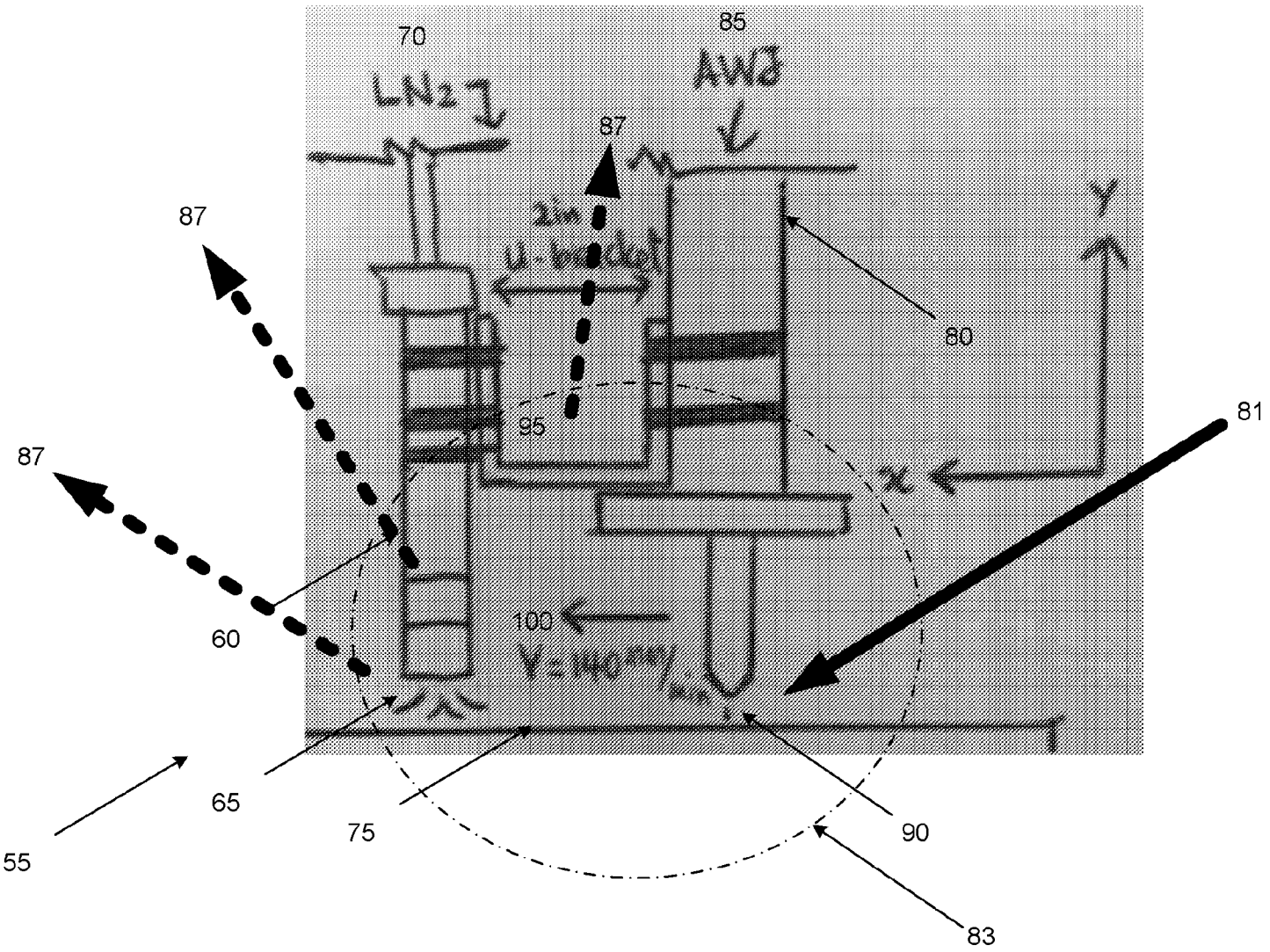
FIG. 3 is an elevation view of a cutting system according to one embodiment of the present invention.

FIG. 3 shows a cutting head 55 for underwater cryogenic assisted water jetting. Here a nozzle 60 directs 65 liquid nitrogen 70 onto a cutting surface 75. A bracket 95 is engaged with the cryogenic nozzle and a water jetting nozzle 80 directing 90 a stream of abrasive water jet 85 onto the cutting surface 75. The bracket acts to ensure the synchronized movement of the nozzles 60, 75, in spaced relation, being 50 mm in this embodiment. The cutting head 55 is arranged to be moved 100 along the cutting surface 75 whereby the liquid nitrogen cryogenically cools the cutting surface 75 beyond the ductile-brittle transition so as to assist in the water cutting of the surface. It will be appreciated this movement may be linear for cutting flat plate, or rotational for cutting a cylindrical pipe or jacket. For a cylindrical pipe or jacket, the cutting head 55 may be directed outward for cutting an internal bore, or radially inward, for cutting from a peripheral circumference. A water repelling shield, in the form of a stream of compressed air 81 drives out water 87 from the cutting zone 83 so as to create arid conditions and thus avoid temperature increases in the cutting surface before the surface is able to be cut. Another form of water repelling shield may be used, including a physical barrier surrounding the cutting zone 83. The barrier may be purpose built to fit the type of cutting surface. Alternatively, as will be shown with reference to FIGS. 4A and 4B, the structure being cut may provide part, or all, of the water repelling shield. Further still, the water repelling shield may be in the form of a de-watering pump, drawing water away from the cutting zone. It will be appreciated that various combinations of compressed air, physical barrier and pumping may for the water repelling shield. The diameter of the nozzle for cryogenic liquid may be between 5 mm to 50 mm. The separation distance, either linear or circumferential, range of distance vary between 0.5 cm to 20 cm. The orientation angle of the cryogenic liquid nozzle makes relative to the target material to cut vary between 90° to 45° to allow better cooling distribution and reduce heat loss. The distance is required to allow adequate cooling for the metal to reach its Ductile Brittle Transition before severance operation by the abrasive water jet. Cutting nozzle stand-off range between 3 mm to 5 mm from the target material. The AWJ slurry could be mix near or far from the nozzle. Subsequently, the diameter nozzle of AWJ is set between 1 mm to 3 mm.

Figure 4B:
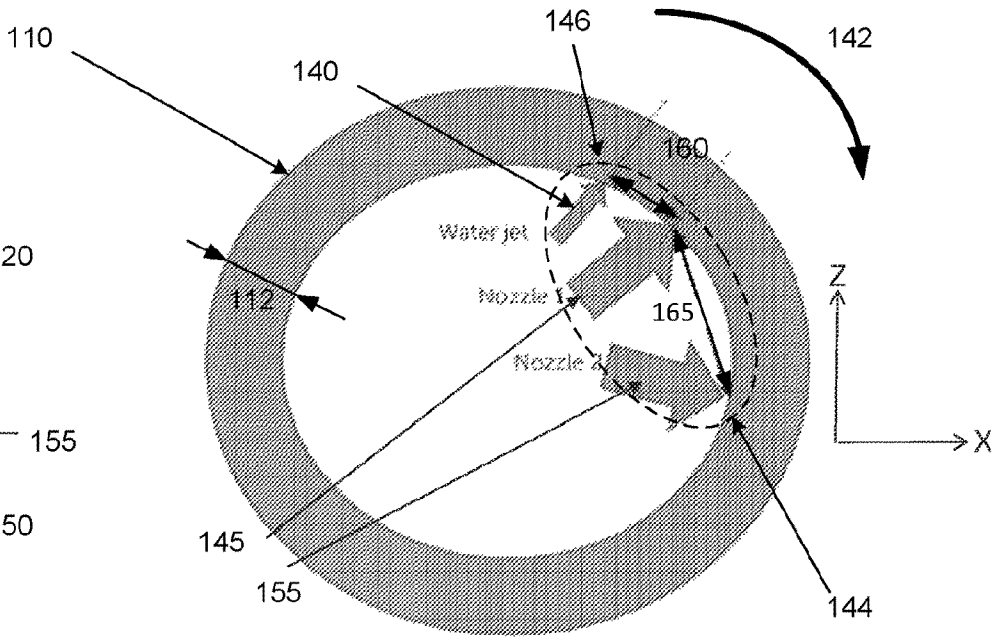
FIGS. 4A and 4B are various views of a cutting system according to a further embodiment of the present invention.
Figure 4A:
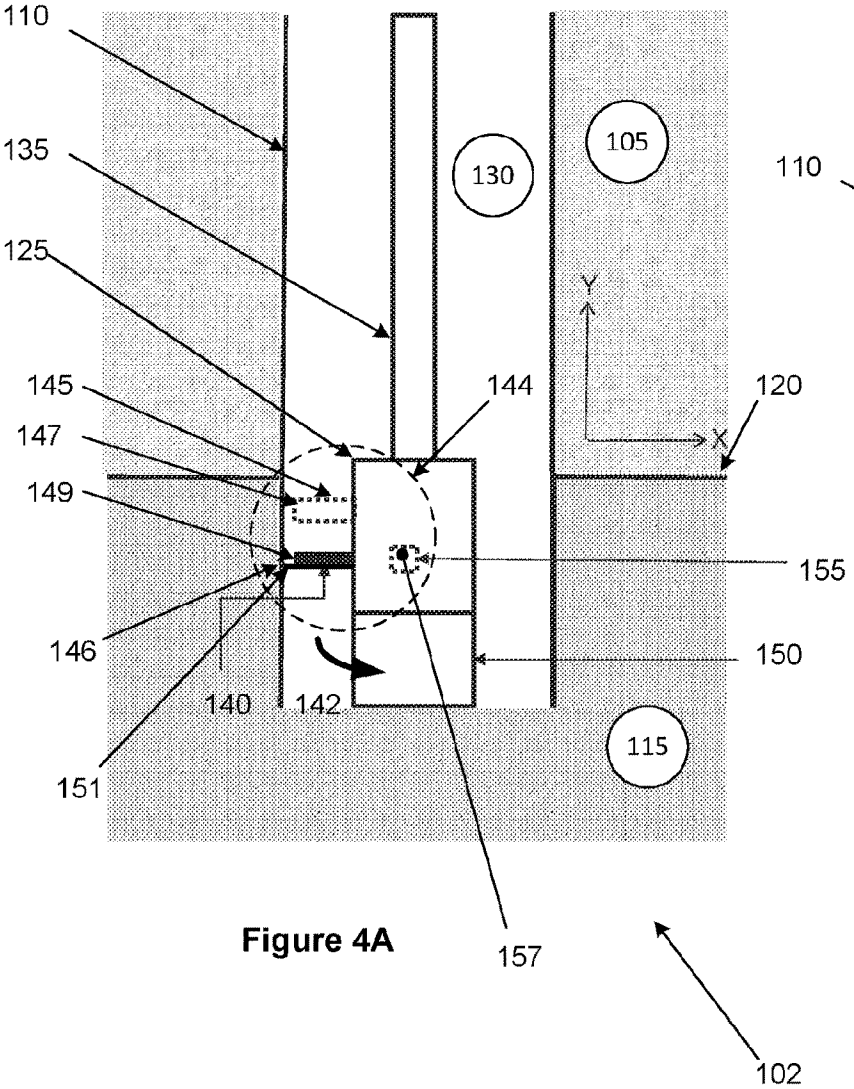

FIGS. 4A and 4B show an alternative embodiment 102. Here, a jacket 110 is located under water 105 and embedded in the seabed 115. In this embodiment the cutting head 125 is positioned within the bore 130 of the jacket 110. Further, the cutting head 125 is integrated with the soil plug removal tool 150, which includes a de-watering pump for evacuating the water and soil. The cutting head 125 includes a first nozzle 145 for directing liquid nitrogen proximate to the water jetting nozzle 140, which define a cutting zone 144 together with the cutting surface 146. The distance between the water jet nozzle 140 and cryogenic nozzles 145, 155, and in particular the various nozzle tips 147, 149, 157, may vary based upon in situ conditions and material to be cut. As a non-limiting example, the distance 160 between the water jet nozzle tip 149 and the first cryogenic nozzle 147 may be in the range 50 to 100 mm. In a further embodiment, a lip or retaining surface 151 may be coupled to the water jetting nozzle 140, or arranged close thereto, such that the lip 151 is in close proximity to, or in contact with, the target material. The lip 151 is arranged to capture and retain a portion of the cryogenic fluid from the cryogenic nozzle 145 as excess cryogenic fluid falls from the nozzle or runs down the surface of the cutting surface. In this way, cryogenic fluid is retained for a longer period at the surface of the target material prior to full evaporation. It follows that the lip 151, therefore, maintains cryogenic conditions at the target surface for a longer period. The lip 151 may be made from a highly ductile material.

In this embodiment, a second cryogenic nozzle 155 is located circumferentially about the cutting tool from the water jet nozzle 140, the offset 165 between nozzle tips 149, 157 being in the range 100 to 200 mm. Thus, it will be noted that in the position shown in FIG. 4A as the cutting head 125 is rotated 142 the first cryogenic nozzle 145, having a nozzle tip 147 is positioned above the water jet nozzle 140, having a nozzle tip 149, and thus providing cryogenic conditions on a continuous basis proximate to the water jet nozzle 140. The second nozzle 155 acts in a similar manner to that of the embodiment of FIG. 3 whereby the second nozzle 155 is in the same horizontal plane as the water jet nozzle 140 and precedes the water jet nozzle as the cutting tool is rotated 142. Thus, having two cryogenic nozzles operating proximate to the water jet, the second nozzle 155 reduces the temperature of the jacket wall 112 with the first nozzle 145 maintaining cryogenic conditions during the cutting process.

In the embodiment of FIGS. 4A and 4B, the air envelope is provided by de-watering the bore 130 of the jacket 110, and so the pump and the internal bore 130 form the water repelling shield for the cutting zone 144. The de-watering pump will need to be sufficient to accommodate water ingress through the base of the jacket during the cutting process. Thus, in this further embodiment the cutting tool and soil plug removal device 150 may include a water pump 135 of greater capacity than may be standard for pumping water out of the borer 130 in order to maintain arid conditions. It follows that integration with the soil plug device 150 provides the air envelope required for underwater cryogenic assisted water jetting.

As a note, the ability to place the cutting head 125 inside the jacket 110 means no site preparation is required around the jacket, unlike several of the prior art systems. Whether the cut is to be made above or below the seabed 120 is irrelevant, subject to the depth of the soil plug. In this embodiment, this is also managed by including the soil plug removal device 150.

The invention claimed is:

1. A system for cutting an underwater structure, the system comprising:

a cutting head, the cutting head comprising:

an abrasive water jetting nozzle;

a cryogenic nozzle;

the abrasive water jetting nozzle and the cryogenic nozzle mounted in fixed spaced relation;

the cutting head arranged to position tips of the abrasive water jetting nozzle and the cryogenic nozzle proximate to a cutting surface of the underwater structure, and arranged to form a cutting zone defined by the nozzle tips and the cutting surface; and wherein a water repelling shield is located about said cutting zone and arranged to create arid conditions in the cutting zone.

2. The system according to claim 1, wherein the water repelling shield includes a nozzle to inject compressed air into the cutting zone, so as to drive water out of the cutting zone.

3. The system according to claim 1, wherein the water repelling shield includes a de-watering pump arranged to pump water from the cutting zone.

4. The system according to claim 2, wherein the water repelling shield includes at least a portion of the underwater structure forming a barrier against water entering the cutting zone.

5. The system according to claim 1, the cutting head further including a second cryogenic nozzle and corresponding second cryogenic nozzle tip, the cutting zone extending to include the second nozzle tip.

6. The system according to claim 3, further including a soil plug removal tool mounted to the cutting head, the de-watering pump mounted to the soil plug removal tool.

7. The system according to claim 1, wherein the underwater structure is a jacket having an internal bore, and wherein the cutting head is arranged to be placed within the bore of the jacket and further arranged to be rotated during cutting of said jacket.

8. A method for cutting an underwater structure, the method comprising the steps of:

placing an abrasive water jetting nozzle and a cryogenic nozzle in fixed spaced relation to form a cutting head positioning the cutting head proximate to a cutting surface of the underwater structure;

forming a cutting zone defined by tips of the abrasive water jetting nozzle and the cryogenic nozzle and the cutting surface;

locating a water repelling shield about the cutting zone;

creating arid conditions in the cutting zone; and cutting the cutting surface using an abrasive water jet emanating from the abrasive water jetting nozzle.

9. The method according to claim 8, wherein the locating step includes the step of injecting compressed air into the cutting zone, and so driving water out of the cutting zone.

10. The method according to claim 8, wherein the locating step includes the step of pumping water out of the cutting zone.

11. The method according to claim 8, wherein the underwater structure is a jacket having an internal bore, the positioning step including inserting the cutting head into the internal bore.

* * * * *